US005322381A

United States Patent [19]

Argo, II

[11] Patent Number: 5,322,381

[45] Date of Patent: Jun. 21, 1994

[54] SEALANT APPLICATOR AND METHOD FOR SEALING HEADED FASTENERS

[76] Inventor: Richard S. Argo, II, 6978 River Road, New Baltimore, Ohio 45030

[21] Appl. No.: 883,451

[22] Filed: May 15, 1992

[51] Int. Cl.[5] ..... B65D 47/00

[52] U.S. Cl. ..... 401/9; 222/566; 222/568; 222/575; 401/261; 401/265; 425/87

[58] Field of Search ..... 401/9, 10, 11, 265, 401/266, 261; 425/87; 222/566, 568, 575

[56] References Cited

U.S. PATENT DOCUMENTS

| | | | |
|---|---|---|---|
| 1,982,833 | 12/1934 | Schmerer | 401/265 X |
| 2,417,262 | 3/1947 | Morehouse | 85/36 |
| 2,836,333 | 5/1958 | Woodel | 222/575 |
| 2,903,739 | 9/1959 | Hann | 425/87 |
| 3,071,294 | 1/1963 | Galbierz | 222/327 |
| 3,093,274 | 6/1963 | Galbierz | 222/541 |
| 3,368,591 | 2/1968 | Zerbetto | 141/23 |
| 3,470,787 | 10/1969 | Mackie | 85/53 |
| 3,982,980 | 9/1976 | van Manen | 156/73.5 |
| 4,069,091 | 1/1978 | van Manen | 156/498 |
| 4,225,253 | 9/1980 | Fraleigh | 401/9 |
| 4,284,213 | 8/1981 | Lee | 222/541 |
| 4,461,454 | 7/1984 | Vadnais | 251/350 |
| 4,923,348 | 5/1990 | Carlozzo et al. | 411/377 |
| 4,971,745 | 11/1990 | Ferenc et al. | 264/263 |
| 5,018,329 | 5/1991 | Hasan | 52/410 |

FOREIGN PATENT DOCUMENTS

| | | | |
|---|---|---|---|
| 291058 | 6/1991 | Fed. Rep. of Germany | 222/566 |
| 44751 | 4/1935 | France | 425/87 |
| 1440779 | 4/1966 | France | 401/265 |
| 150763 | 1/1932 | Switzerland | 222/568 |

*Primary Examiner*—Steven A. Bratlie

*Attorney, Agent, or Firm*—Nies, Kurz, Bergert & Tamburro

[57] ABSTRACT

An applicator tip structure and method for applying a flexible sealant material on and around the heads of fasteners and on and around the surface surrounding the fastener head to prevent fluid passage between the fastener and the materials through which the fastener passes. The applicator tip has an outlet opening that is greater than the diameter of the sealant passageway in the applicator tip and that also is greater than the largest transverse dimension of the fastener, to provide an overlap area around the fastener head. In use the applicator tip is applied over the fastener head and is pressed into the surrounding surface around the fastener head to define an enclosure around the fastener head, into which enclosure the sealant material is injected to completely surround the fastener head and the adjacent surface to completely seal the fastener from fluid passage therearound.

11 Claims, 1 Drawing Sheet

SEALANT APPLICATOR AND METHOD FOR SEALING HEADED FASTENERS

BACKGROUND OF THE INVENTION

1. Field of the Invention

The present invention relates to sealing of the heads of fasteners, such as nails, bolts, and the like, to the surrounding surface into which the fastener extends, to prevent the passage of liquids under the fastener head and along the fastener body. More particularly, the present invention relates to a sealant applicator tip structure and to a method of applying a resilient sealant compound over and around the head of a fastener to provide a fluid-tight seal between the fastener head and the surrounding surface.

2. Description of the Related Art

Flat headed fasteners, such as nails, screws, bolts, or the like, frequently work loose over time to cause the fastener head to be spaced from the surface of the material into which the fastener extends. For example, when roofing materials such as shingles, or other roofing materials is sheet form are applied by nailing the materials to a roof sub-surface, or to trusses or other structural members that support a roof, the periodic variation from the high temperatures of summer to the low temperatures of winter, and back to high temperatures again, as well as the temperature changes that occur over the course of a twenty-four hour period, can cause differential expansion and contraction of the roofing material and the underlying structural materials. The differential expansion and contraction tends to work loose the nails that were originally firmly driven into the underlying structure. Typically, the nails are pushed upwardly and outwardly from the nail hole, as a result of which the nail heads are separated from the surrounding surface and the nail holes become enlarged, leaving a gap so that rain can pass between the nail head and the surrounding surface, and can also pass between the nail shank and the nail hole to flow along the nail hole and along the loosened nail, and finally into the interior of the structure over which the roof extends. Other causes for nail loosening include earth and resulting foundation shifts and wind forces, all of which impose changing stresses on the structure, also tending to work the roofing nails loose. In addition to permitting rain leaks, the enlarged nail holes can become rotted after time, as a result of which the nails would no longer serve to securely hold the roofing material in place.

Various types of auxiliary connection arrangements have been proposed to overcome the separation and leakage problems of the type described above. For example, in U.S. Pat. No. 2,417,262, which issued on Mar. 11, 1947, to E. M. Morehouse, there is disclosed a sealing nut including a preformed, jacket-like outer member formed of rubber or other flexible material to provide a fluid-tight seal.

In U.S. Pat. No. 3,470,787, which issued on Oct. 7, 1969, to W. L. Mackie, there is disclosed a corrosion preventive device in the form of a dome-shaped cap defining a cavity that is filled with a sealing material, such as silicone rubber. A closure film is applied over the sealing material. In use, the closure film is removed from the cap, which is then manually pressed over the head of the fastener to prevent corrosion of the fastener head.

In U.S. Pat. No. 5,018,329, which issued on May 28, 1991, to S. Riaz Hasan et al., a roofing fastener is disclosed wherein a roofing washer is placed against the lower face o a nail head and a molded thermoplastic insert is positioned between the nail head and the washer. The thermoplastic insert is softened by heating to heat weld the parts together.

It is an object of the present invention to provide an improved sealing arrangement that does not require costly, separately formed molded parts, that permits sealing of new or existing fasteners quickly and without excessive labor, and that provides a long-lasting seal around a fastener head.

SUMMARY OF THE INVENTION

Briefly stated, in accordance with one aspect of the present invention a sealant applicator tip is provided for applying a sealant to the head of a fastener that is in fastening position with the fastener head overlying a portion of the surface surrounding the fastener. The tip is in the form of a tubular body that includes a tubular through passageway and that has a connection at one end of the tubular body for affixing the body to a sealant container. A dispensing opening that communicates with the tubular passageway is provided at the other end of the tubular body. The dispensing opening has a diameter greater than the diameter of the tubular passageway and that also is greater than the largest transverse dimension of a fastener head to be sealed, so that the dispensing opening completely surrounds the fastener head to permit sealant to be deposited completely around the fastener head.

In accordance with another aspect of the present invention, a method is provided for sealing the head of a headed fastener to a surrounding surface to prevent passage of a fluid around the fastener head and along the fastener body. A sealant applicator is provided, the applicator including an applicator tip with a sealant discharge opening having a diameter greater than the largest dimension of the head of the fastener to be sealed. The discharge opening is defined by an annular collar having an inner surface along which sealant is adapted to flow, the collar having an end face for providing at least line contact of the applicator tip with the surrounding surface. The applicator tip is positioned over the head of the fastener with the collar end face placed against the surface and the collar inner surface spaced from the head of the fastener. The applicator tip is pressed tightly against the surface surrounding the fastener head to define a sealant enclosure around the fastener head. While the applicator tip is pressed against the surrounding surface, the sealant is forced from the sealant applicator to the discharge opening and into the sealant enclosure to completely surround and completely cover the outer edges and the top of the fastener head, as well as the adjacent surface, so that the sealant flows into any spaces or gaps that exist between the fastener head and the surrounding surface. The applicator tip is then withdrawn from the surface and the sealant is allowed to cure.

DESCRIPTION OF THE PREFERRED EMBODIMENTS

Figure 1:
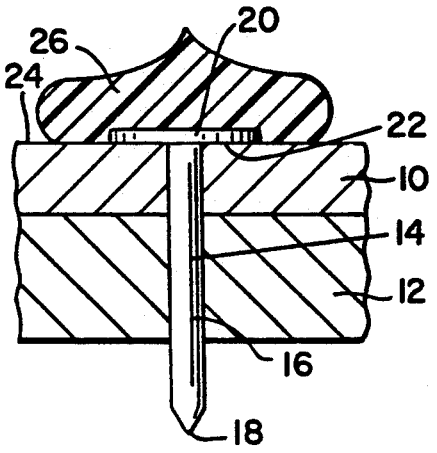
FIG. 1 is a cross-sectional, side elevational view of a fastener having a head in contact with the surface surrounding the fastener, and including a sealant that has been applied on and around the fastener head in accordance with the present invention.

Referring now to the drawings, and particularly to FIG. 1 thereof, there is shown a first material layer 10 and a second material layer 12, each of which is joined to the other by a fastener 14 that fully penetrates layer 10 and at least partially penetrates layer 12. Layer 10 can be a sheet of roofing material, such as galvanized metal sheet or an asphalt-based shingle. Layer 12 can be an underlayment of tar paper, felt, or the like, or it can be a structural member forming part of the structural support for the roofing material.

Fastener 14 includes a slender, elongated, cylindrical body 16 terminating at one end in a sharpened point 18 to facilitate the penetration of materials by fastener 14, and terminating at the opposite end in a head 20 having a substantially flat lower surface 22 that is in firm contact with the upper surface 24 of first material layer 10. Fastener 14 as shown is in the form of a common nail, although alternatively it can be a screw, a bolt, or the like. In any event, fastener 14 is characterized by a slender body that includes an enlarged head having a flat lower surface to securely hold down the several layers of material through which the fastener passes.

Positioned about head 20 of fastener 14 is a sealant material 26 that is deposited on and completely around head 20 in an amount sufficient to cover head 20 completely, as well as to cover the surrounding portion of surface 24. Preferably, sealant material 26 extends for at least about ⅛ inch laterally outwardly of and around the perimeter of head 20, and it is in intimate contact with surface 24 to tightly bond thereto. The quantity of sealant material 26 applied to the fastener is sufficient to completely cover the top and sides of head 20 of fastener 14, along with the adjacent area of surface 24, and it serves to prevent the passage around and between head 14 and surface 24 of fluid that might exist on or that might impinge upon surface 24.

Preferably, the sealant material is a silicone rubber that is impervious to heat, sunlight, cold, and the elements, as well as to contaminants and chemical substances in the air, and also to acid rain. Additionally, silicone rubber also has a long service life over which it remains flexible and does not dry out, become brittle, or crumble over time. A suitable silicone rubber material is manufactured by Dow Corning Corporation, of Midland Michigan. Other materials having the desired properties can also be employed.

Figure 2:
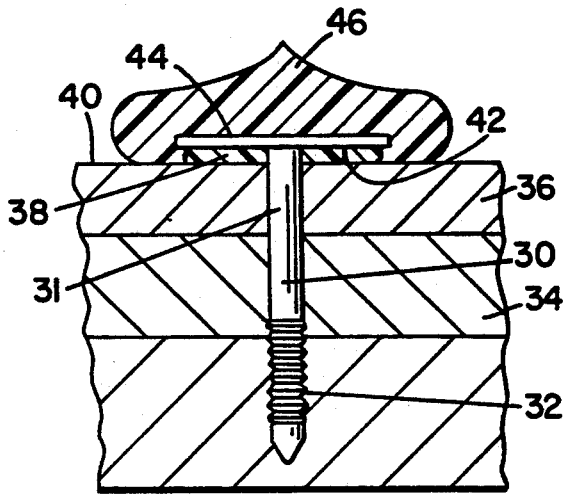
FIG. 2 is a cross-sectional view similar to FIG. 1 showing a different fastener structure, in fastening position and sealed accordance with the present invention.

In FIG. 2 is shown the present invention as applied to roofing nails utilized to secure a roofing material, such as metal sheets or composition roofs, such as asphalt shingles, to an underlying structural element. As shown, a roofing nail 30 has a cylindrical body 31 that includes a series of longitudinally spaced, peripheral annular rings 32 that are adapted to firmly engage and grip material 34, which can be a wood framing member, or the like. The roofing material 36 is held in position against material 34 by the contact between a resilient rubber washer 38 that is positioned between surface 40 of roofing material 36 and the lowermost, flat undersurface 42 of nail head 44. As in the FIG. 1 embodiment, the sealant material 46 is applied to completely cover the top and sides of nail head 44, and also to cover the exposed sides of resilient washer 38. Additionally, sealant material 46 extends outwardly beyond the side edges of nail head 44, and it also extends inwardly into any gaps or spaces that might exist between nail head 44, resilient washer 38, and surface 40, to provide a complete and fluid-tight seal around the nail head to prevent the entry past nail 30 of fluids that might be present on surface 40.

Figure 3:
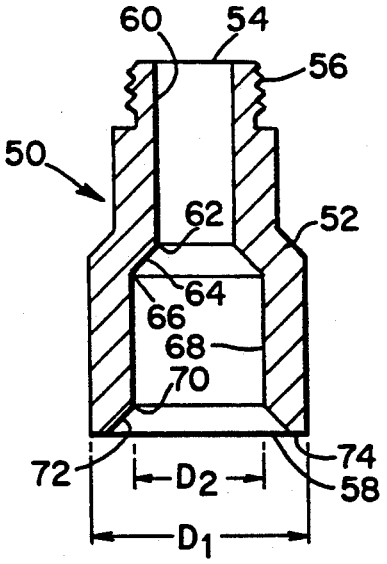
FIG. 3 is a longitudinal cross-sectional view of one form of sealant applicator tip in accordance with the present invention.

One form of applicator tip that can be employed to provide the fluid-tight cover and seal of sealant material as illustrated in FIGS. 1 and 2 is shown in FIG. 3. A sealant container (not shown), which can be a tubular container of the well-known type for use with a caulking gun, has attached thereto a tubular applicator tip 50 having a body 52, and a first open end 54 surrounded by an externally threaded sleeve 56 for connecting tip 50 with a corresponding internally threaded portion of a sealant container. An example of a sealant container structure that can be employed is illustrated and described in U.S. Pat. No. 4,284,213, which issued on Aug. 18, 1981, to Headie O. Lee, the disclosure of which is hereby incorporated herein by reference to the same extent as if fully set forth herein.

At the end of tip 50 opposite from first end 54 is second open end 58, from which the sealant is expelled. Extending inwardly from first end 54 and toward second end 58 is a first, constant diameter passageway section 60 having a uniform diameter portion defined by a first diameter. Passageway section 60 terminates at point 62 spaced along the longitudinal axis of tip 50 between first end 54 and second end 58.

A first transition section 64 extends from point 62 toward second opening 58 and flares outwardly to terminate at point 66, spaced along the longitudinal axis of tip 50 between point 62 and second end 58. The diameter of the passageway is greater at point 66 than at point 62.

A second passageway section 68 has a uniform second diameter portion defined by a second, constant diameter. Second passageway section 68 extends from point 66 to point 70, spaced along the longitudinal axis of tip 50 between point 66 and second end 58. Point 70 is spaced inwardly from second outlet 58. A second transition section 72 flares outwardly from point 70 toward second outlet opening 58.

Preferably, the inclination angles of transition sections 64 and 72 relative to the longitudinal axis of tip 50 are each about 45° for smooth flow of sealant. And the ratio of the outer diameter of tip 50 at outlet 58($D_1$) to the diameter of second passageway 68 ($D_2$) is preferably about 2:1 to provide an annular end face 74 of sufficient width to assure continuous contact of tip 50 with the roofing area around the fastener. Additionally, the axial length of second passageway section 68, taken along the longitudinal axis of tip 50 is preferably about the same as the diameter at second passageway section 68, in order to provide sufficient internal volume within the end of the tip to assure complete coverage of sealant over the top surface of the fastener.

The diameter of second outlet 58 at the outermost end of transition section 72, based upon tests conducted, is preferably at least about ⅛ inch larger than the outer diameter of the head of the fastener to be sealed, to provide a sufficient thickness or overlap of sealant beyond the outer edge of the fastener head in order to assure complete and intimate contact area between the sealant and the surface surrounding the fastener to be sealed, and to allow for slight misalignment of the axis of the fastener head and the axis of outlet 58 of tip 50.

Figure 4:
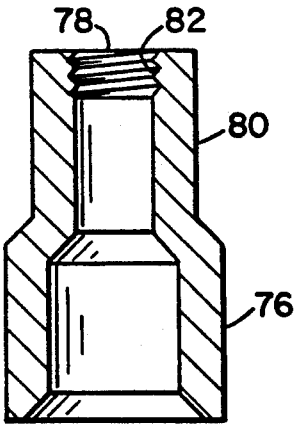
FIG. 4 is a longitudinal, cross-sectional view similar to FIG. 3, showing another form of applicator tip.

In FIG. 4, a similar applicator tip structure 76 is shown, except that first end 78 includes an axially extending collar 80 that has an internal thread 82 to permit attachment of tip 76 to an externally threaded outlet appendage on a sealant container (not shown). Finally, each of applicator tips 50 and 76 is preferably symmetrical about a longitudinal centerline for ease of manufacture.

In operation, after the fastener has been properly positioned in the roofing material and underlying structure, applicator tip 50 of a sealant container is positioned over the fastener head and is carefully lowered onto the surrounding roofing surface to provide complete contact between the surface of the roofing material and the end face of the applicator tip. The inner surface of the tip outlet is preferably spaced laterally from the outer edges of the fastener head so that sealant can flow over and cover those edges. The applicator tip is then pressed tightly against the surrounding surface to define a closed sealant enclosure around the fastener head. While the applicator tip is pressed against the surrounding surface, sealant is forced from the sealant applicator into the sealant tip and into the sealant enclosure to completely surround the outer edges of the fastener head so that the sealant flows into any spaces or gaps between the fastener head and the surrounding surface.

The sealant tip is then withdrawn from the roofing surface and away from the fastener head. Because of the high viscosity of the sealant, upon withdrawal of the applicator tip from the fastener head the sealant necks down to define a strand that forms a center, conical portion of sealant, which aids in visually determining from a distance which fastener heads have been covered.

Although particular embodiments of the present invention have been illustrated and described, it will be apparent to those skilled in the art that various changes and modifications can be made without departing from the spirit of the present invention. It is therefore intended to encompass within the appended claims all such changes and modifications that fall within the scope of the present invention.

What is claimed is:

1. An applicator tip for applying a sealant to the head of a fastener that is in fastening position with the fastener head overlying a portion of a surface surrounding the fastener, said tip comprising:

a) a tubular body, including a tubular through passageway extending between a first end of the tubular body and a second end of the tubular body, and a connection at the first end of the tubular body for connecting the tubular body with a sealant container, wherein the tubular passageway includes a first constant area portion adjacent the first end of the tubular body and having a first diameter, and a second constant area portion downstream of the first constant area portion and having a second diameter, wherein the second constant area portion has a diameter greater than the diameter of the first constant area portion;

b) a dispensing opening provided at the second end of the tubular body and communicating with the tubular passageway, the dispensing opening having a diameter greater than the second diameter of the tubular passageway and greater than a largest transverse dimension of a fastener head to be sealed, so that the dispensing opening completely surrounds the fastener head in spaced relationship with the periphery of the fastener head to permit sealant to be deposited completely around the fastener head.

2. An applicator tip in accordance with claim 1 wherein the outer diameter of the tubular body at the dispensing opening is about twice the diameter of the second constant area portion.

3. An applicator tip in accordance with claim 1 wherein the diameter of the second constant diameter portion is substantially equal to the diameter of the dispensing opening.

4. An applicator tip in accordance with claim 3, including an outwardly diverging portion positioned between the first constant diameter portion and the second constant area portion.

5. An applicator tip in accordance with claim 1 wherein the dispensing opening is circular.

6. An applicator tip in accordance with claim 5 wherein the dispensing opening lies in a plane that is transverse to the longitudinal axis of the tubular body.

7. An applicator tip in accordance with claim 1 wherein the tip includes a flat annular land surrounding the dispensing opening.

8. A method of sealing the head of a headed fastener to a surrounding surface to prevent passage of a fluid around the fastener head and along the fastener shank, said method comprising:

a) providing a sealant applicator including an applicator tip with a tubular body including a sealant discharge opening having a diameter greater than the largest transverse dimension of the head of the fastener to be sealed, the discharge opening defined by an annular collar having an inner surface along which a viscous sealant is adapted to flow, the collar having an end face for providing at least closed line contact of the applicator tip end with the surface surrounding the fastener, the tubular body, including a tubular through passageway extending between a first end of the tubular body and a second end of the tubular body, and a connection at the first end of the tubular body for connecting the tubular body with a sealant container, wherein the tubular passageway includes a first constant area portion adjacent the first end of the tubular body and having a first diameter, and a second constant area portion downstream of the first constant area portion and having a second diameter, wherein the second constant area portion has a diameter greater than the diameter of the first constant area portion;

b) positioning the applicator tip over the head of the fastener with the collar end face placed against the surface surrounding the fastener and the collar inner surface spaced from the head of the fastener;

c) pressing the applicator tip tightly against the surrounding surface to define a sealant enclosure around the fastener head;

d) while the applicator tip is pressed against the surrounding surface, forcing sealant from the sealant applicator into the applicator tip and into the sealant enclosure to completely surround outer edges of the fastener head so that the sealant flows into any spaces between the fastener head and the surrounding surface;

e) withdrawing the applicator tip axially outwardly from the fastener and the surrounding surface; and f) allowing the sealant to cure.

9. A method in accordance with claim 8 including the additional step of causing sealant to flow from the applicator tip as the applicator tip is being withdrawn from around the fastener head.

10. A method in accordance with claim 8 including the additional step of providing a silicone-rubber-based sealant in the sealant applicator.

11. A method in accordance with claim 8 including the step of providing an applicator tip having an outwardly diverging flow zone immediately inwardly of the collar end face.

* * * * *